United States Patent [19]

Yee

[11] Patent Number: 4,692,052

[45] Date of Patent: Sep. 8, 1987

[54] SPLICE SLEEVE FOR OVERLAPPING REINFORCING BARS

[75] Inventor: Alfred A. Yee, Honolulu, Hi.

[73] Assignee: Elizabeth W. Yee, Honolulu, Hi.

[21] Appl. No.: 878,336

[22] Filed: Jun. 25, 1986

[51] Int. Cl.[4] ..... B25G 3/00; F16D 1/00

[52] U.S. Cl. ..... 403/13; 403/265; 403/268

[58] Field of Search ..... 403/268, 265, 266, 267, 403/300, 393, 341, 13

[56] References Cited

U.S. PATENT DOCUMENTS

| | | | |
|---|---|---|---|
| 1,689,281 | 10/1928 | Forsell | 403/265 |
| 3,540,763 | 11/1970 | Yee | 403/265 |
| 3,552,787 | 1/1971 | Yee | 403/265 |
| 3,638,978 | 2/1972 | Guntermann | 403/267 |

FOREIGN PATENT DOCUMENTS

| | | | |
|---|---|---|---|
| 1801577 | 5/1971 | Fed. Rep. of Germany | 403/267 |
| 1482335 | 4/1967 | France | 403/300 |

*Primary Examiner*—Andrew V. Kundrat
*Attorney, Agent, or Firm*—Harvey B. Jacobson

[57] ABSTRACT

A splice sleeve for connecting overlapping reinforcing bars utilized in various types of structures in which steel reinforcing bars are utilized and it is desired to connect the overlapping end portions of the reinforcing bars. The splice sleeve includes a rigid tubular sleeve receiving the overlaped ends of the reinforcing bars with the tubular sleeve being filled with hardable material to resist axial tension exerted on the reinforcing bars. In one embodiment, one end of the sleeve is closed by a rubber grommet having an opening receiving one of the reinforcing bars and the other end of the sleeve may be outwardly flared or trumpeted and provided with a ring welded thereto for receiving an end of one of the reinforcing bars with the sleeve confining the hardenable material and resisting radial outward forces imparted to the hardenable material when axial tension is exerted on the reinforcing bars. In other embodiments, the sleeve is in the form of a section of corrugated pipe or a section of rigid cylindrical pipe with ribs or grooves.

14 Claims, 4 Drawing Figures

SPLICE SLEEVE FOR OVERLAPPING REINFORCING BARS

BACKGROUND OF THE INVENTION

1. Field of the Invention

The present invention generally relates to a splice sleeve for connecting overlapping reinforcing bars utilized in various types of structures in which steel reinforcing bars are utilized and it is desired to connect the overlapping end portions of the reinforcing bars. The splice sleeve includes a tubular sleeve receiving the overlapped ends of the reinforcing bars with the tubular sleeve being filled with hardenable material to resist axial tension exerted on the reinforcing bars. The sleeve may be vertically or horizontally oriented or inclined with one end of the sleeve being optionally closed by a rubber grommet having an opening receiving one of the reinforcing bars and the other end of the sleeve being optionally outwardly flared or trumpeted and provided with a ring or hat-shaped cap welded thereto for receiving a tapered or flat end of one of the reinforcing bars with the sleeve confining the hardenable material and resisting radial outward forces imparted to the hardenable material when axial tension is exerted on the reinforcing bars.

2. Information Disclosure Statement

Splice sleeves for reinforcing bars are well known as exemplified in my prior U.S. Pat. No. 3,540,763 issued Nov. 17, 1970 for SPLICE SLEEVE FOR REINFORCING BARS. In this patent, the reinforcing bars connected by a sleeve and cementitious material are in axial alignment. While this type of sleeve is effective in the arrangement disclosed, the present invention includes a structure for connecting reinforcing bars having overlapping ends and thus is patentably different from the above mentioned patent and the other prior art in this field of endeavor.

SUMMARY OF THE INVENTION

An object of the present invention is to provide a splice sleeve for overlapping reinforcing bars in the form of a rigid tubular sleeve which may be in the form of a section of standard steel pipe with the overlapping ends of the reinforcing bars positioned in the sleeve and the space between the reinforcing bars and between the bars and the sleeve being filled with hardable cementitious material such as grouting or the like so that the sleeve will restrain any radial displacement of the cementitious material thereby developing a confinement of the cementitious material and preventing it from outward movement thereby resulting in substantial resistance to axial tension failure or displacement of the lapped reinforcing bars.

Another object of the invention is to provide a splice sleeve for overlapping reinforcing bars as set forth in the preceding object in which the sleeve includes a closure member for the lower end thereof in the form of a grommet of rubber or other resilient material having an aperture therethrough closely receiving the upper end of a lower reinforcing bar with the upper end portion of the sleeve including a rigid ring welded thereto for engaging the terminal upper end of the lower reinforcing bar thereby positioning the lower reinforcing bar and sleeve in predetermined fixed relation to each other with the lower end of the upper reinforcing bar being inserted into the sleeve into contact with the closure at the lower end thereof to assure complete overlapping relationship of the reinforcing bars within the sleeve.

A further object of the invention is to provide a splice sleeve in accordance with the preceding objects in which the upper end of the sleeve is outwardly flared or trumpeted to facilitate assembly of the reinforcing bars and sleeve and the periphery of the sleeve is provided with vertically spaced holes to enable insertion of cementitious material by connection with suitable tubes or other supply means in order to fill the sleeve with cementitious material.

A still further object of the invention is to provide a splice sleeve in the form of a corrugated pipe section or an internally grooved pipe section in which the corrugations and grooves are spiral or annular.

Still another object of the invention is to provide a splice sleeve for overlapping reinforcing bars which is simple in construction, easy to assemble and effective for securely retaining the overlapped ends of reinforcing bars in connected relation in order to resist axial tension exerted on the reinforcing bars.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
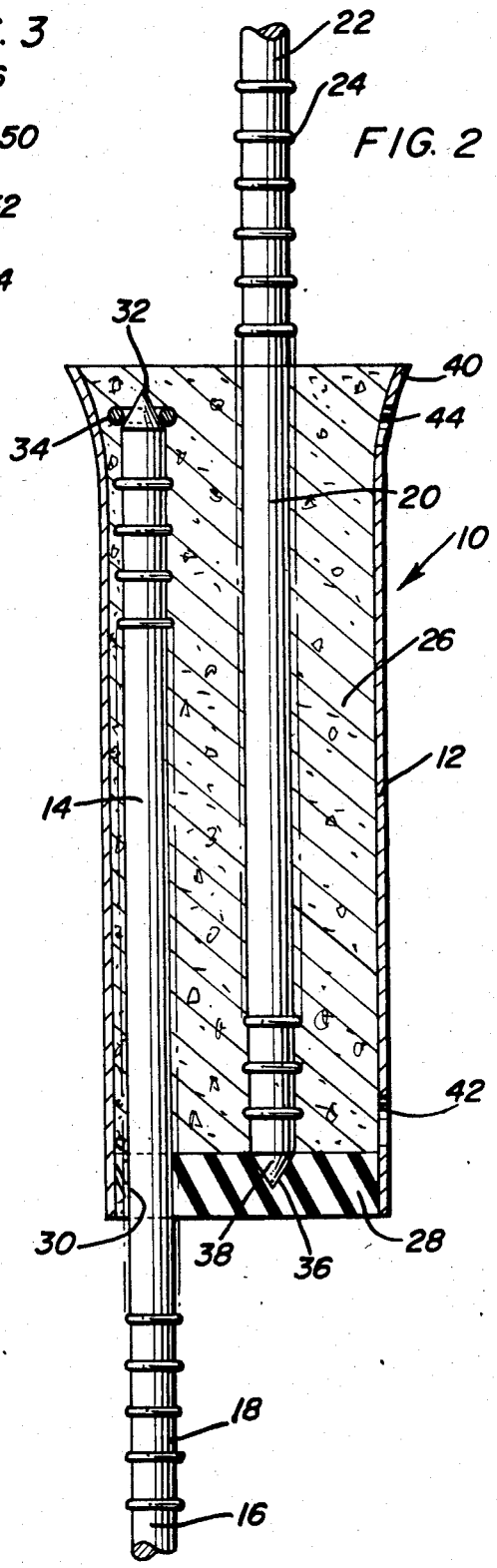
FIG. 2 is a vertical sectional view, on an enlarged scale, taken along section line 2—2 on FIG. 1 illustrating further structural details of the splice sleeve and the relationship of the splice sleeve to the axially oriented and overlapping ends of the reinforcing bars and the cementitious medium filling the sleeve.

Referring now specifically to the drawings, the splice sleeve of the present invention is generally designated by numeral 10 and includes a short section of rigid steel tubing or pipe forming a sleeve 12 of cylindrical configuration. The sleeve 12 receives the upper end portion 14 of a lower reinforcing bar 16 having longitudinally spaced peripheral ribs or projections 18 thereon. The sleeve 12 also receives the lower end portion 20 of an upper reinforcing bar 22 which also has longitudinally spaced peripheral ribs or projections 24 thereon with the reinforcing bars being conventional and normally employed in various types of structures utilizing concrete with reinforcing bars. As illustrated in FIG. 2, the upper end portion 14 of the lower reinforcing bar 16 and the lower end portion 20 of the upper reinforcing bar 22 are received in the sleeve 12 in spaced and overlapping relation and the space between the portions 14 and 20 of the reinforcing bars and between the sleeve 12 and the reinforcing bars is filled with a cementitious medium 26 in the form of grouting or the like which has non-shrink and slightly expansive properties.

The sleeve 12 is vertically oriented and is provided with a closure in the lower end thereof in the form of a grommet 28 of rubber or similar resilient material having an opening 30 therethrough adjacent the periphery thereof and adjacent the wall of the sleeve 12 as illustrated in FIG. 2 for receiving therethrough the upper end portion 14 of the lower reinforcing bar 16 with the terminal upper end of the reinforcing bar 16 preferably being provided with a conical or pointed end 32 for reception in an annular ring 34 of suitable rigid metal that is secured to the interior of the sleeve 12 as by welding or by any other suitable rigid fastening means. Thus, when the upper end portion 14 of the lower reinforcing bar 16 is inserted through the aperture 30, the sleeve and lower reinforcing bar are continued to be assembled until the pointed end 32 comes to rest in engagement with the ring 34 thereby accurately positioning the reinforcing bar 16 and sleeve 12 in desired relationship to each other with the grommet 28 forming a substantial closure for the lower end of the sleeve 12 to retain the cementitious medium therein until it hardens.

The rubber grommet 28 also prevents leakage of surrounding cement/concrete into the sleeve 12. The upper surface of the rubber grommet 28 may be provided with a recess 36 spaced from the aperture 30 for receiving the pointed lower end 38 of the lower end portion 20 of the upper reinforcing bar 22. Alternatively, the pointed end 38 of the upper reinforcing bar 22 may be lowered into contact with the rubber grommet and form its own recess due to the force with which the pointed end 38 engages the rubber grommet 28. As illustrated, the upper end of the sleeve 12 can be outwardly flared or trumpeted as at 40 in order to provide easier insertion of the upper reinforcing rod 22 into the interior of the sleeve 12. Also, the purpose for the tapering or pointed ends 32 and 38 is to facilitate easier fitting of the reinforcing bars into the splice sleeve. The sleeve 12 includes holes 42 and 44 adjacent the lower and upper end thereof to supply cementitious material, grouting or the like into the interior of the sleeve and completely fill the interior of the sleeve and completely embed the overlapping ends of the reinforcing bars so that the deformations, rings or projections 18 and 24 will be intimately engaged and contacted by the cementitious medium. When the cementitious medium hardens and axial tension is exerted on the reinforcing bars 16 and 22 as illustrated by the force arrows in FIG. 2, the forces perpendicular to the longitudinal axis of the reinforcing bars due to the deformations, ribs or projections acting on the cementitious material will be confined within the sleeve with the sleeve imposing an opposite force in order to create a very secure frictional engagement between the reinforcing bars and cementitious medium.

Thus, the sleeve and its association with the reinforcing bars and cementitious medium provides a confinement to the forces perpendicular to axial tension exerted on the reinforcing bars with the confinement providing an opposite force imposed on the reinforcing bars to create the secure frictional engagement of the reinforcing bars with the cementitious material thereby effectively connecting the reinforcing bars.

Figure 1:
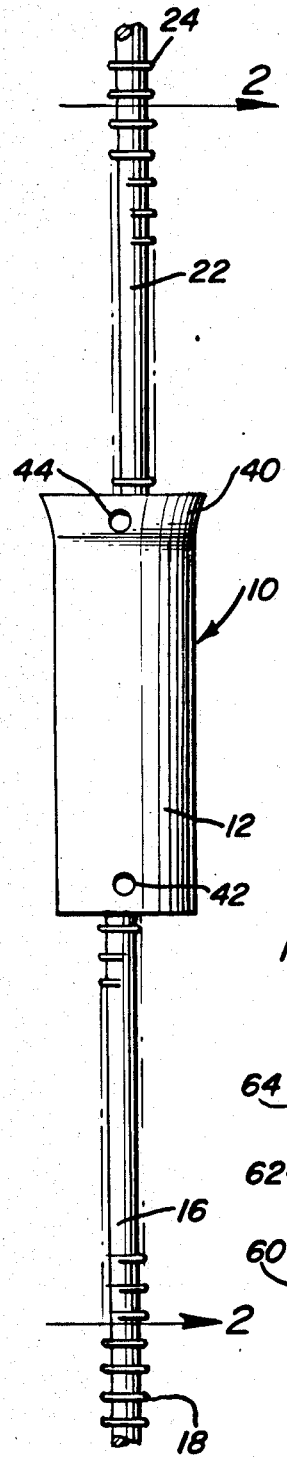
FIG. 1 is an elevational view of the splice sleeve and reinforcing bars connected thereby.
Figure 3:
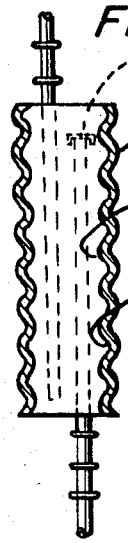
FIG. 3 is a longitudinal sectional view illustrating a splice sleeve in the form of a corrugated pipe section.
Figure 4:
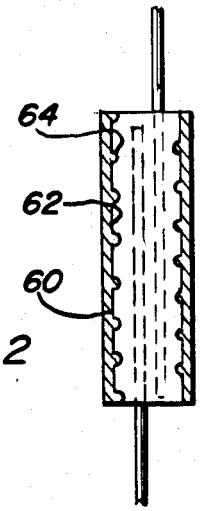
FIG. 4 is a longitudinal sectional view illustrating a splice sleeve in the form of an internally grooved pipe.

As shown in FIG. 3, the splice sleeve is a section of corrugated pipe 50 having a series of internal and external ribs or ridges 52 and valleys 54, either spiral or annular, for interlocking engagement with the hardenable material which receive the overlapping ends of the reinforcing bars and functions in generally the same manner as the sleeve in FIG. 2. FIG. 4 illustrates another embodiment in which the splice sleeve 60 is a pipe section having internal grooves 62 and ridges 64, either spiral or annular, for interlocking engagement with the hardenable material which receives the overlapping ends of the reinforcing bars. A hat-shaped cap or bottle cap 66 of sheet metal may be tack welded to the interior of any of the sleeves to receive the end of a reinforcing bar.

The reinforcing bars are conventional items used in reinforcing various types of concrete/cement structures and the sleeve may be a section of conventional steel pipe capable of resisting the radial forces perpendicular to the tension forces exerted on the reinforcing bars with the steel pipe or sleeve restraining any perpendicular displacement of the cementitious medium thereby developing a confinement and resulting resistance to any tension failure or displacement of the lapped splice.

The various embodiments may be oriented vertically, horizontally or inclined depending on the connections to be made between between overlapping reinforcing bars. Also, the splice sleeve may be optionally provided with an outwardly flared end or ends. Hardenable material other than cementitious grouting, such as epoxy material, can be used. In some uses, the hardenable material can be placed into the sleeve through the end thereof before inserting the bars thereby eliminating the filler holes in the sleeve.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A splice sleeve comprising a rigid sleeve, end portions of axially extending reinforcing bars being disposed in said sleeve in overlapping relation, and cementitious material enclosing the overlapping ends of the reinforcing bars and filling the transverse cross-sectionaal area of the sleeve for resisting forces perpendicular to the longitudinal axes of the reinforcing bars when axial tension is exerted on the overlapping reinforcing bars thereby imposing an opposite force toward the overlapping ends of the reinforcing bars to develop a secure frictional engagement between the reinforcing bars and cementitious material to securely retain the overlapping ends of the reinforcing bars in overlapped relation, said sleeve having an internal cross-sectional configuration substantially larger than the combined cross-sectional area of the overlapping ends of the reinforcing bars positioned within the sleeve, one end of said sleeve being provided with a closure plug having an opening therein receiving an end portion of one of the reinforcing bars, the other end portion of the sleeve including a guide ring rigidly affixed to the interior surface thereof for receiving the terminal end of the reinforcing bar inserted through the opening in the closure plug for the sleeve.

2. The structure as defined in claim 1 wherein said closure plug is in the form of a grommet of resilient material with the inner surface of the grommet receiving and engaged by the terminal end of the other reinforcing bar in order to position the end portions of the reinforcing bars in spaced overlapped relation.

3. The structure as defined in claim 1 wherein the end of the sleeve having the guide ring rigidly affixed thereto is outwardly flared to facilitate insertion of the reinforcing bars therein.

4. The structure as defined in claim 1 wherein said sleeve includes openings adjacent the ends thereof for receiving tubes to supply cementitious material into the interior of the sleeve.

5. The structure as defined in claim 1 wherein said sleeve is in the form of a section of standard pipe having a cylindrical exterior and interior surface with the sleeve being vertically oriented for receiving vertically disposed overlapping end portions of axially extending reinforcing bars having radial projecting ribs formed thereon in longitudinally spaced relation.

6. A splice sleeve comprising a rigid sleeve, end portions of axially extending reinforcing bars being disposed in said sleeve in overlapping relation, and cementitious material eclosing the overlapping ends of the reinforcing bars and filling the transversse cross-sectional area of the sleeve for resisting forces perpendicular to the longitudical axes of the reinforcing bars when axial tension is exerted on the overlapping reinforcing bars thereby imposing an opposite force toward the overlapping ends of the reinforcing bars to develop a secure frictional engagement between the reinforcing bars and cementitious material to securely retians the overlapping ends of the reinforcing bars in overlapped relation, said sleeve being in the form of a section of standard pipe having a cylindrical exterior and interior surface with the sleeve being vertically oriented for receiving vertically disposed overlapping end portions of axially extending reinforcing bars having radial projecting ribs formed thereon in longitudinally spaced relation, said sleeve having its lower end closed by a rubber grommet having an opening therein receiving the upper end of the lower reinforcing bar with the upper end portion of the sleeve including a guide ring in alignment with the opening in the grommet for receiving a pointed upper terminal end of the lower reinforcing bar, the upper reinforcing bar including a pointed terminal end engaged with the upper surface of the rubber grommet with the upper surface of the grommet including a recess receiving the pointed lower end of the upper reinforcing bar.

7. In combination, a pair of axially extending reinforcing bars having peripheral projections thereon, said bars having overlapping ends disposed in adjacent, generally parallel spaced relation, a rigid splice sleeve with means locating said end portions of the axially extending reinforcing bars therein, and hardened medium enclosing the overlapping ends of the reinforcing bars and filling the transverse cross-sectional area of the sleeve for resisting forces perpendicular to the longitudinal axes of the reinforcing bars when axial tension is exerted on the overlapping reinforcing bars with the sleeve imposing opposite forces toward the overlapping ends of the reinforcing bars to develop a secure frictional engagement between the reinforcing bars and hardened medium to securely retain the overlapping ends of the reinforcing bars in overlapped relation.

8. The structure as defined in claim 7 wherein one end of said sleeve is provided with a closure plug having an opening therein receiving an end portion of one of the reinforcing bars.

9. The structure as defined in claim 8 wherein the other end portion of the sleeve includes a guide ring rigidly affixed to the interior surface thereof for receiving the tapered terminal end of the reinforcing bar inserted through the opening in the closure plug for the sleeve.

10. The structure as defined in claim 7 wherein said sleeve is a section of corrugated pipe.

11. The structure as defined in claim 7 wherein said sleeve is a section of pipe having internal grooves.

12. The structure as defined in claim 9 wherein said sleeve has an outwardly flared end to guide a reinforcing bar into the sleeve.

13. The structure as defined in claim 7 wherein one end portion of the sleeve includes a shallow cap forming an inwardly facing socket receiving a flat ended portion of a reinforcing bar.

14. The structure as defined in claim 3 wherein said rigid sleeve is spaced radially from the overlapping ends of the reinforcing bars withd the hardened medium completely enclosing the spaced overlapping ends of the reinforcing bars, means forming a closure for one end portion of the sleeve to facilitate its use in a vertical position, said closure means including an opening receiving one of the overlapping ends in close fitting relation to retain the hardened medium within the sleeve prior to it hardening when the sleeve is used in a vertical position with the closure means oriented below the other end of the sleeve and means stabilizing the end portion of the overlapping end of the reinforcing bar inserted upwardly through the closure means.

* * * * *